US007976596B2

(12) United States Patent
Egan et al.

(10) Patent No.: US 7,976,596 B2
(45) Date of Patent: Jul. 12, 2011

(54) HIGH DENSITY ABRASIVE COMPACTS

(75) Inventors: David Egan, Kilkishen (IE); Gerald F. Flynn, Newmarket-on-Fergus (IE)

(73) Assignee: Element Six Limited, County Clare (IE)

( * ) Notice: Subject to any disclaimer, the term of this patent is extended or adjusted under 35 U.S.C. 154(b) by 712 days.

(21) Appl. No.: 11/575,094

(22) PCT Filed: Sep. 9, 2005

(86) PCT No.: PCT/IB2005/002672

§ 371 (c)(1), (2), (4) Date: Mar. 12, 2007

(87) PCT Pub. No.: WO2006/027675

PCT Pub. Date: Mar. 16, 2006

(65) Prior Publication Data

US 2008/0168718 A1 Jul. 17, 2008

(30) Foreign Application Priority Data

Sep. 10, 2004 (IE) ..... S2004/0605

(51) Int. Cl.

| | |
|---|---|
| ***B24D 3/00*** | (2006.01) |
| ***B24D 11/00*** | (2006.01) |
| ***B24D 18/00*** | (2006.01) |
| ***B24D 3/02*** | (2006.01) |
| ***C09K 3/14*** | (2006.01) |
| ***C09C 1/68*** | (2006.01) |

(52) U.S. Cl. ..... 51/307; 51/308; 51/309; 51/293

(58) Field of Classification Search ..... 51/307, 51/308, 309, 293, 37

See application file for complete search history.

(56) References Cited

U.S. PATENT DOCUMENTS

| | | | | |
|---|---|---|---|---|
| 5,169,572 | A * | 12/1992 | Matthews | 264/430 |
| 5,529,746 | A | 6/1996 | Knoess et al. | |
| 6,613,114 | B1 * | 9/2003 | Alary | 51/309 |
| 7,632,434 | B2 * | 12/2009 | Duescher | 264/12 |

FOREIGN PATENT DOCUMENTS

| | | |
|---|---|---|
| DE | 198 27 665 | 12/1999 |
| EP | 1 028 171 | 8/2000 |

* cited by examiner

*Primary Examiner* — James E McDonough

(74) *Attorney, Agent, or Firm* — Oblon, Spivak, McClelland, Maier & Neustadt, L.L.P.

(57) ABSTRACT

A method of producing a high-density abrasive compact material includes the steps of providing an electrically conductive mixture of a bonding powder material and abrasive particles or grit; compressing the electrically conductive mixture; and subjecting the compressed electrically conductive mixture to one or more high current pulses to form the abrasive compact is provided.

13 Claims, 7 Drawing Sheets

HIGH DENSITY ABRASIVE COMPACTS

BACKGROUND OF THE INVENTION

This invention relates to a process for producing high-density abrasive compacts, in particular high-density diamond impregnated compacts.

A typical fabrication process commonly used in the manufacture of diamond impregnated compacts utilises powder metallurgy (PM) technology, whereby a mixture of diamond grit and bonding powders, predominantly metallic, is consolidated to form a cutting tool. Although hot pressing to net shape has become widespread, the powders can also be densified using other PM processes such as pressure-less sintering or hot isostatic pressing, or a combination of the two, extrusion, laser melting, a combination of hot pressing and laser cutting, and other similar techniques, for example.

The hot pressing process consists of the simultaneous application of heat and pressure so as to obtain a product nearly free from internal porosity. Compared to the conventional cold press/high temperature sintering PM route, hot pressing requires holding the powder for a shorter time (usually 2-6 minutes) at a lower temperature, but under a compressive force, to reach a higher density level. Hot pressing is generally accomplished using resistance heating equipment and graphite moulds. The graphite moulds offer higher efficiency in segment production and, at elevated temperatures, protect both the metal powder and diamond grit against oxidation. Although the use of coated diamond can also offer a certain degree of protection, certain powder mixtures can require temperatures which would considerably damage the diamond during sintering.

A properly densified metal matrix diamond mixture acquires a narrow hardness range which, to a great extent, is affected by the matrix composition. If, however, the structure of the segment deviates substantially in any respect, or if the densification is incomplete, the hardness does not fall within the specified range. Incompletely densified materials usually have extremely low toughness, which may result in poor wear resistance and poor diamond retention.

SUMMARY OF THE INVENTION

According to the invention, a method of producing a high-density abrasive compact material includes the steps of:

(a) providing an electrically conductive mixture of a bonding powder material and abrasive particles or grit, in particular diamond abrasive particles or grit;

(b) compressing the electrically conductive mixture; and (c) subjecting the compressed electrically conductive mixture to one or more high current pulses to form the abrasive compact.

The bonding powder material may be a metal powder material or it may comprise semi-conductor powder material, either alone or in combination with the metal powder material. The semi-conductor powder material may be selected from any one or more of silicon (Si), germanium (Ge) and gallium (Ga)

The abrasive particles are preferably diamond abrasive particles but may also be selected from cubic boron nitride (cBN), alumina ($Al_2O_3$), silicon carbide (SiC), silicon nitride ($Si_3Ni_4$), emery, garnet, WC and zirconia. The term 'grit' is intended to encompass abrasive particles of a smaller size than particles, in particular less than 50/60 mesh (#) size.

The diamond particles and/or grit are preferably encapsulated and/or granulated with the powder material. In a preferred aspect to the present invention the abrasive particles are encapsulated by the powder material and/or the abrasive grit is granulated with the powder material. Through the use of conventional encapsulation and/or granulating techniques known in the art it becomes possible to produce a homogenous bonding powder material/abrasive mixture.

In terms of the present invention, the term 'encapsulation' is intended to encompass the surrounding of the particles and/or grit by the powder material in a manner such that the surrounding powder material essentially remains in position surrounding the particles. Preferably, encapsulation is achieved by way of the additional of a suitable binder which may be subsequently removed, for example during pre-heating or pre-sintering. Examples of suitable binders include but are not limited to PolyVinylAlcohol (PVA), PolyVinylButyral (PVB) PolyEthyleneGlycol (PEG), stearates, waxes and paraffins.

In addition to the above, the abrasive particles may be pre-coated with a metal coating. Suitable coatings include but are not limited to titanium carbide, chromium carbide, titanium metal and tungsten metal.

The diamond particles and/or grit are preferably partially sintered before being compressed.

The electrically conductive mixture is preferably pre-pressed near net shape prior to being sintered.

The electrically conductive material is preferably placed under a vacuum during the compressing step (b), or during the pre-pressing step, or both.

The compressed electrically conductive mixture or pre-pressed compact is preferably pre-heated before being subjected to the high current pulse(s).

The term 'high current pulse' is intended to encompass a pulse in excess of 1 $kA/cm^2$. Preheating may be achieved in an inert atmosphere or vacuum to prevent oxidation of the powder materials. Pre-heating could also be achieved by passing a direct current through the punches and thus the sample while in the die.

Suitable examples of bonding metal powder material include but are not limited to iron, cobalt, copper, bronzes, brasses and Ni or mixtures thereof, or pre-alloyed materials based on these metals. Non-conducting additives such as metallic carbides, nitrides or oxides can also be included into the powder material as well as cermets. It will be appreciated that other materials such as Mo, W, Nb, Al, Ti, V, Cr, Zr, Ag, Sn, Ta, Pt and Au may also be used.

DETAILED DESCRIPTION OF PREFERRED EMBODIMENTS

The invention relates to a process for the production of high-density compacts from a dry, electrically conductive, preferably metal/cermet powder material mixture impregnated with abrasive particles, preferably diamond particles and/or grit, whereby a density of greater than 99% is achieved. The diamond particles and/or grit may be naturally derived but it is preferably synthetic. The diamond grit may be pre-coated. For said purpose, static pressing of the powder/diamond mixture is superimposed by the application of an electric current to the punches of the press. This process is especially suitable, but not limited to the mass production of sintered diamond wear parts/cutting elements as used in tools such as segmented saw blades or wire saws.

The invention therefore extends to an abrasive compact including an abrasive material such as diamond particles or grit, the compact having a density greater than 99%. The compact preferably has a density greater than 99.1%, more preferably greater than 99.2%, more preferably greater than 99.3%, more preferably greater than 99.4%, more preferably greater than 99.5%, more preferably greater than 99.6%, more preferably greater than 99.7%, more preferably greater than 99.8%, more preferably greater than 99.9%.

The method is carried out in a press having conductive punches made out of suitable material such as copper or copper/silver infiltrated tungsten, a copper/tungsten alloy or powder metallurgical molybdenum and an insulating die into which the punches fit. Preferably the copper/tungsten mixture is from 10/90 to 50/50, for example 30/70. As mentioned above, silver infiltrated materials are also suitable.

The press is preferably a hydraulic press but it will be appreciated that other types of presses, for example pneumatic or threaded, may also be used.

The high current pulses which pass through the punches can sometimes result in bonding or welding of the mixture of powder material and abrasive particles to the punches. It is therefore desirable to include an additional conductive layer between the punch and the mixture, for example a coating layer having a thickness of microns. A Cu infiltrated W can be used as a disc placed to separate the Cu based punch from the material to be sintered which reduces the risk of welding. The coating layer may be substantially pure tungsten metal or other high melting point and/or oxidation resistant metal, for example, Mo, Nb, Pt, Pd and Ta etc. In one embodiment of this invention a sacrificial copper shim is included between the punches which could bond with the compact but not the punches. It will be appreciated that in use, the copper will not negatively interfere with the form or function of the compact so manufactured.

The abovementioned press arrangement is outlined generally in U.S. Pat. No. 5,529,746, which is incorporated herein by reference, although the material for the punches according to the present invention is somewhat different and will not result in a utile product according to the teachings of the above U.S. patent.

The conductive powder material/diamond mixture is placed into the die between the punches. Energy for sintering is supplied via a bank of capacitors, which are discharged through the punches (and therefore the powder material/diamond mixture) via a high current transformer. It will be appreciated that using such a method, a high density abrasive compact including abrasive particles and/or grit can be achieved at temperatures significantly lower than that taught in the art. This energy discharge is in the form of a very high current pulse of short duration. Current pulses can range from 1 kA/cm$^2$ to 20,000 kA/cm$^2$, preferred values being between 50 kA/cm$^2$ and 500 kA/cm$^2$. Current pulses are may be more than 1 kA/cm$^2$, preferably more than 50 kA/cm$^2$, more preferably more than 100 kA/cm$^2$, more preferably more than 200 kA/cm$^2$, more preferably more than 300 kA/cm$^2$ and most preferably more than 400 kA/cm$^2$. Current pulses may be less than 10,000 kA/cm$^2$, preferably less than 5,000 kA/cm$^2$, more preferably less than 2,000 kA/cm$^2$, more preferably less than 1,000 kA/cm$^2$ and most preferably less than 750 kA/cm$^2$.

The voltage used is preferably not more than 24V.

Pulse durations are typically between 0.1 and 50 milliseconds, preferred values being between 1 and 10 milliseconds. Pulse duration may be greater than 0.1 milliseconds, greater than 0.5 milliseconds, greater than 1.0 milliseconds, greater than 2.5 milliseconds and most preferably greater than 10 milliseconds. Pulse duration may be less than 50 milliseconds, less than 45 milliseconds, less than 40 milliseconds, less than 30 milliseconds, less than 20 milliseconds, less than 10 milliseconds and most preferably less than 5 milliseconds.

Sintering of such a component is localised and, being highly efficient, excess heating is unnecessary. This results in the component emerging from the die-punch assembly at a temperature typically below 300 deg C.

The process of the invention is capable of producing fully finished products without the necessity of incorporating subsequent production steps, such as additional sintering and/or deburring, for example.

Whilst the basic principles and equipment disclosed in U.S. Pat. No. 5,529,746 are utilised in the present invention, the process of the present invention has had to be significantly modified in order to be effective for use with diamond impregnated metal powders.

The use of organic materials is well known in producing granules for use in producing abrasive compacts incorporating diamond. However, in the present invention, this could result in explosive decomposition during application of this method and must be avoided. Because of this, initial tests were conducted with powders free from organic binders, which were accordingly very dry and resulted in very easy separation of powder and diamond. At high diamond concentrations, the diamond was segregated from the metal powder during handling. This affected the flow of the current pulse resulting in a badly sintered compact and damage to the diamond.

However, it was found that by encapsulating the diamond and/or precoating the diamond in a metal coating and/or granulating the powder material, a homogenous current density could be produced resulting in a well-sintered compact. This also results in a homogeneous distribution of diamond within the compact. Suitable metal coatings include titanium carbide, chromium carbide, titanium metal, and tungsten metal, for example.

In view of the problems associated with the use of organic binders, it can be necessary to remove the binder used in the production of the individual ingredients before preparing the final metal/diamond mixture. The binder may be useful in the encapsulation process described above, for example. This is typically achieved by heating the raw materials, which can also result in sintering of the encapsulating material. Heating to remove the binder is effective at approximately 200 to 500 deg C. Pre-sintering of the compact is most effective if carried out in temperature range of 600 to 1200 deg C. depending on the metal used in the bonding powder material.

In this regard, it has also been found that when fully sintered, encapsulated grit or granulated powder is used in the method of the invention, the method appears incapable of producing components with a density of more than 99%. However, when the encapsulated grit or granulated powder is only partially sintered whilst removing the organic binder, more dense components result.

The punches used have two functions, viz., to press the component during sintering and carry the electric current pulse required for compacting/sintering the powder materials. Copper is an obvious material from which to produce these punches because of its high conductivity, but its low strength limits the force that can be applied during sintering. By using a Cu/Cr alloy in the initial testing in accordance with a preferred embodiment of the invention, it was found that the pressure applied during sintering can be increased while still retaining a high conductivity without damage to the punches as occurred with standard copper. However, even with such modified punches, the achievable pressures are not sufficient to reach the levels required for cold pressing of diamond impregnated abrasive compacts. By pre-pressing near net shaped components using high strength steel punches and dies before sintering, an initial high density can be achieved resulting in less work during final sintering and also a shorter punch travel during sintering.

As a consequence of the speed of sintering applied in accordance with this method, trapping gas in pores is likely. It is well known in conventional solid state sintering of materials that the removal of gas filled closed pores is very difficult and time consuming. By sintering in a vacuum before pore closure, the pores contain little (or significantly reduced amounts of) gas, resulting in a significant improvement in the sintered components. Accordingly, placing the die under a vacuum and removing any gas which could prevent pore closure ensures a better sintered component using a vacuum. Using a vacuum while pre-pressing will also improve densification.

Any equipment built according to this specification will have an upper energy limit restricted by the charge capacity of the capacitor bank and current throughput of the transformer. The energy required to sinter a fixed volume of material can be reduced by pre-heating either the pre-pressed compact before sintering or the encapsulated/granulated diamond can be pre-heated itself. The energy input during pre-heating reduces the total energy needed for sintering. Therefore, greater volumes can be sintered using the same equipment and/or sintering may be improved.

The compacts may include from 0.01 to 75% volume diamond or other abrasive particles. Preferably the compacts include greater than 20% volume, more preferably greater than 23% volume, for example 25% volume diamond or other abrasive material. The compacts may contain less than 50%volume, preferably less than 40% volume, more preferably less than 30% volume for example 27% volume diamond or other abrasive material.

The invention will now be described in more detail, by way of example only, with reference to the following non-limiting examples and figures in which FIG. 1 shows the densification increase of a compact as a function of pre-pressing;

EXAMPLE 1

Discs having a diameter of about 16 mm and a thickness of about 5 mm containing WC and Co with 25/30 mesh (#) sized diamond particles were cold pressed at 6 tonne per $cm^2$ in a steel die. The WC and Co were encapsulated to surround each individual diamond particle and partially fired to remove the binder and give strength to the granules. These were separately sintered in an apparatus as generally described above using two current pulses at 100% power.

Two sets of samples were made, the second set of samples having an increased diamond concentration over the first.

A Paarl Granite cylindrical bar of diameter about 150 mm was mounted in a lathe. Each of the discs in turn was used to turn the granite using the following parameters:—

Speed: 50 r/min

Depth of Cut: 2 mm

Feed rate: 0.1 mm/revolution

Each disc was allowed to cut for 4 minutes. In addition to the discs of the invention, a similar sized disc of standard tungsten carbide mining grade was sourced. This tungsten carbide disc was tested under the same conditions as the diamond containing discs for comparative purposes.

All of the diamond containing discs continued to cut for the duration of the test. By contrast, the carbide disc cut for about 10 seconds, whereafter it only rubbed the surface. Accordingly, this was stopped after less than 30 seconds.

As is common in a test of this nature, the discs developed a wear scar or wear flat. The depth of this wear flat or wear scar was measured for each of the discs, and the results are set out below.

| | Sample 1 | Sample 2 | Carbide |
|---|---|---|---|
| First set | 1.82 mm | 1.83 mm | 2 mm |
| Second set | 0.98 | 1.09 | — |

It is clear from the first set of Samples tested that the diamond containing discs of the invention are capable of cutting the granite where the carbide disc is not. In addition, the diamond containing material has a much better wear resistance than carbide alone, as evidenced by the smaller wear scar.

The second set of Samples tested show that by increasing the diamond concentration in the discs, an improvement in the wear resistance of the material is observed, once again as evidenced by the smaller wear scar.

EXAMPLE 2

Figure 1:
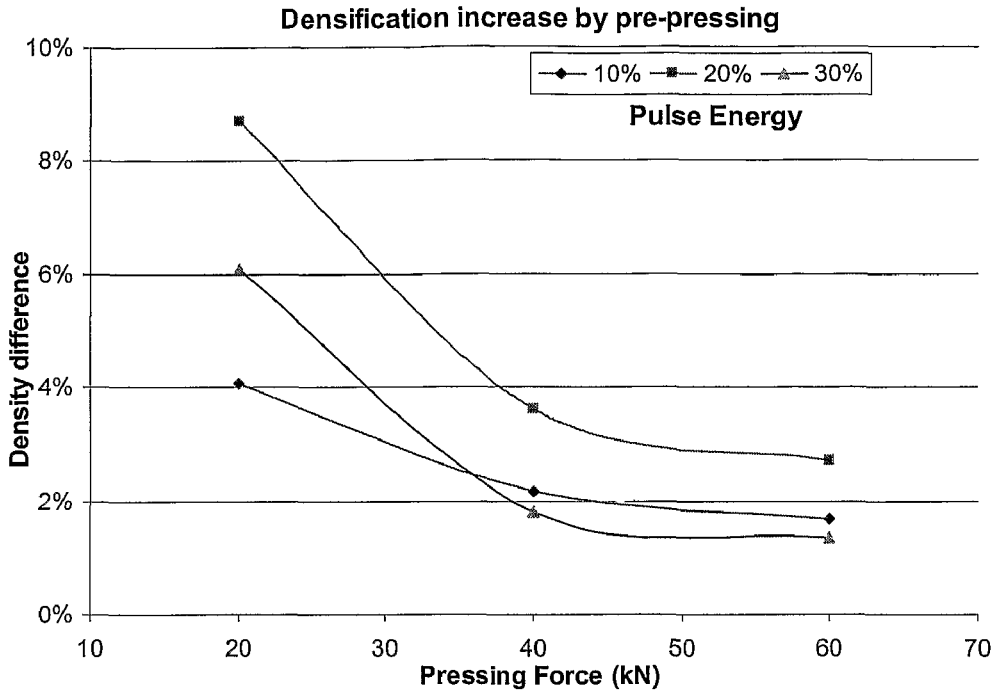

30/35# diamond encapsulated with 26% cobalt and 20-50 micron tungsten carbide was used. To produce thin discs of this material, 5.12 g was used in a 13.81 mm diameter die. As a base line, to investigate the effect of pressing force and pulse energy, a matrix of tests were performed at varying pressing forces (20, 40 & 60 kN) and pulse energies (10, 20 and 30%). This matrix was repeated but using pre-pressed compacts. The densification increase which resulted by using pre-pressing is shown in FIG. 1. The effect is greatest at lower pressing force.

Figure 2:
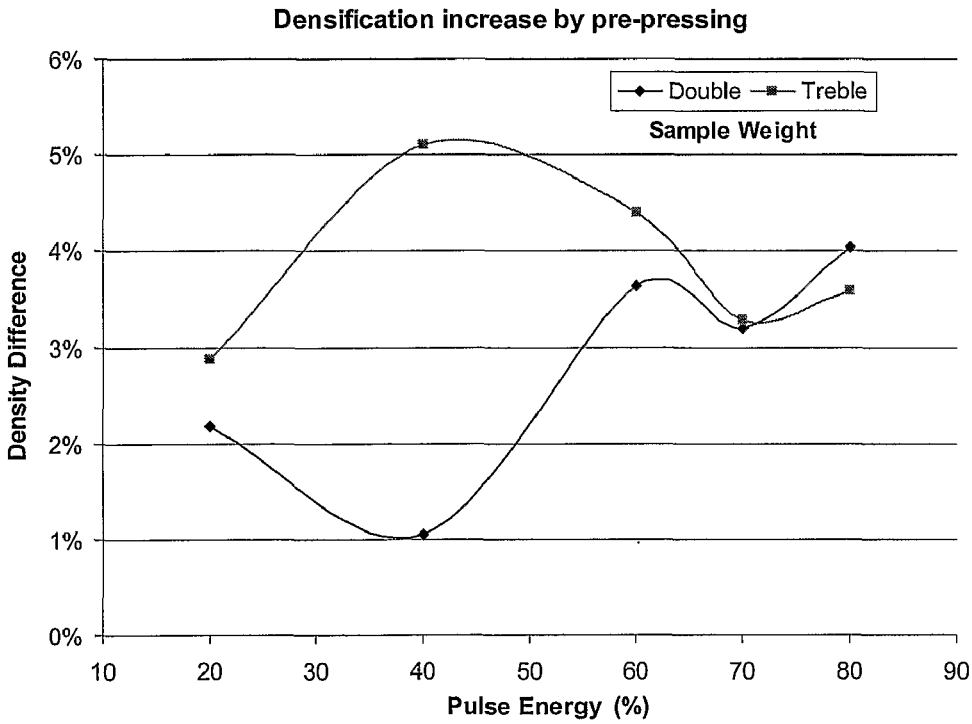
FIG. 2 shows the densification increase of a compact as a function of pre-pressing using double and treble material weight.

Further tests were done using twice (10.24 g) and three times (15.36 g) the material weight while holding the pressing force at 40 kN. Pulse energies of 20, 40, 60, 70 & 80% were used. As before, these tests were repeated using pre-pressed compacts. In this case, the densification increase which resulted is shown in FIG. 2. At higher pulse energies, the effect is about the same.

Figure 3:
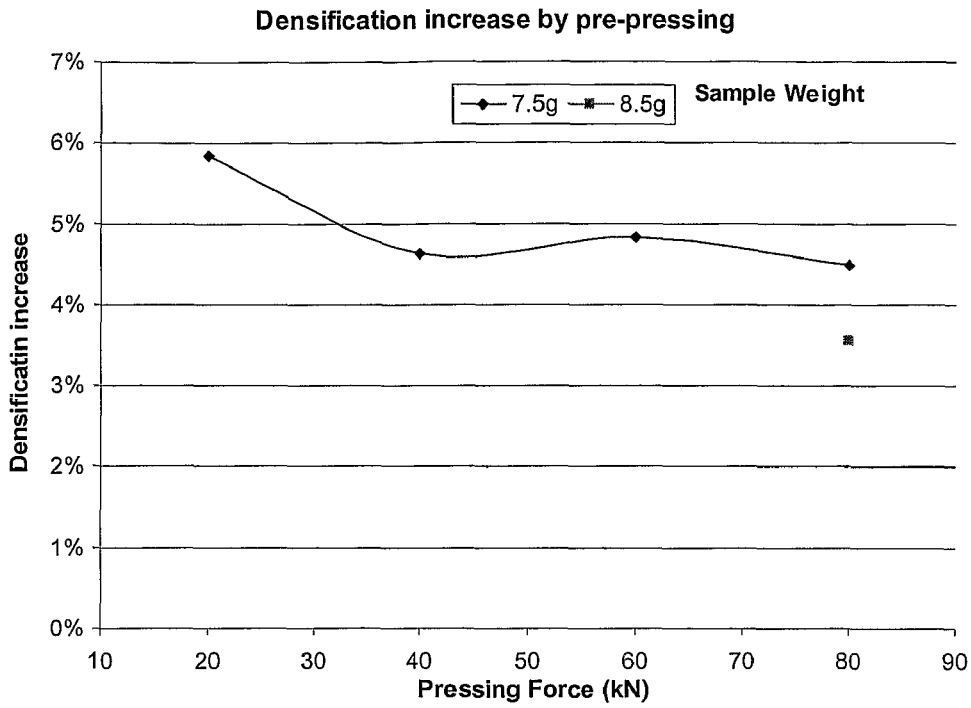
FIG. 3 shows the densification increase of a compact as a function of pre-pressing using the maximum capacity of the mould; and one example using more than the maximum powder capacity of the mould.

Using a 9.5 mm diameter mould, the maximum amount of encapsulated diamond which could be sintered was determined to be 7.5 g. Keeping the pressing force equivalent to that previously, (20 kN for this lower area), the maximum capacity of the mould was sintered at 20, 40, 60 and 80% pulse energy. As before these were repeated using pre-pressed compacts. In addition to this, 8.5 g which is greater than the 9.5 mm sintering chamber capacity, was also pre-pressed and sintered at 80% power. FIG. 3 shows the increase in densification which resulted and also that more material can be sintered when pre-pressed.

EXAMPLE 3

Figure 4:
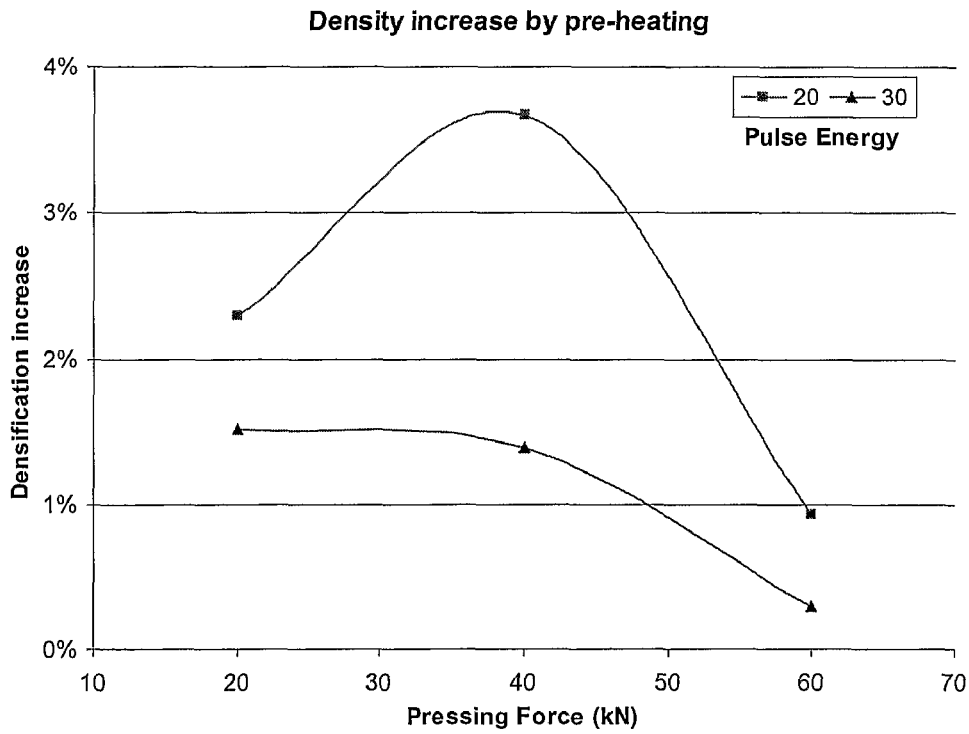
FIG. 4 shows the densification increase of a compact as a function of pre-heating.

A repeat of the 5.12 g samples pre-pressed was performed but this time preheating the compacts to 200 deg C. before placing in the sintering chamber. Pre-heated samples were sintered at 20 & 30% pulse energy with pressing forces of 20, 40 & 60 kN being used. The densification of these was compared to the pre-pressed samples sintered without heating. The densification increase as a result of pre-heating is shown in FIG. 4.

EXAMPLE 4

Figure 5:
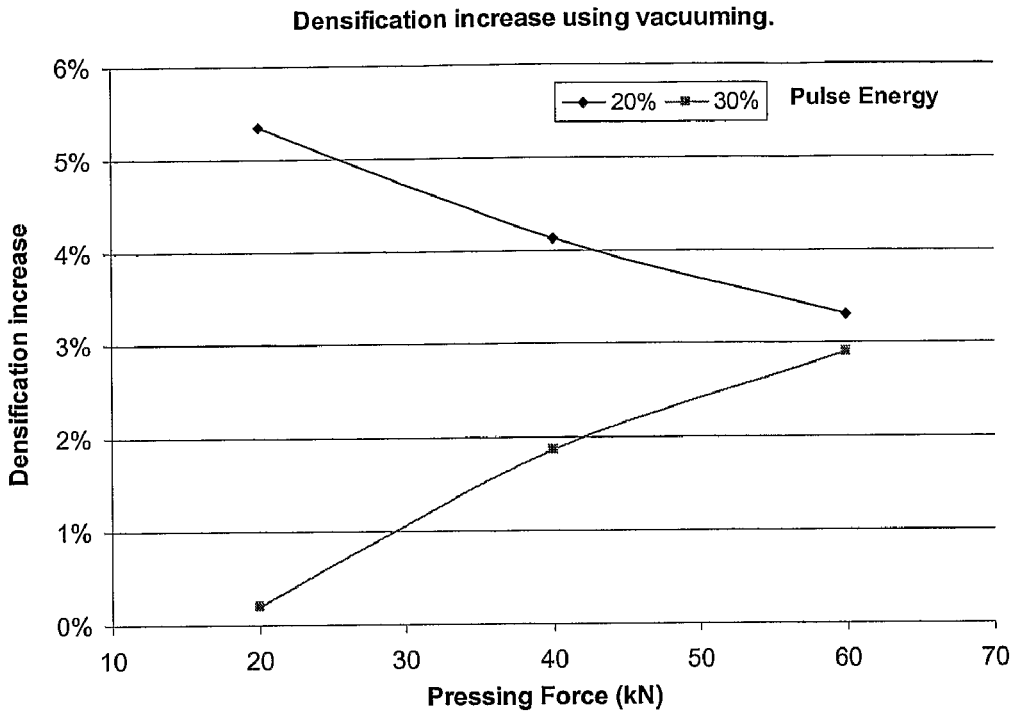
FIG. 5 shows the densification increase of a compact as a function of vacuuming.
Figure 6:
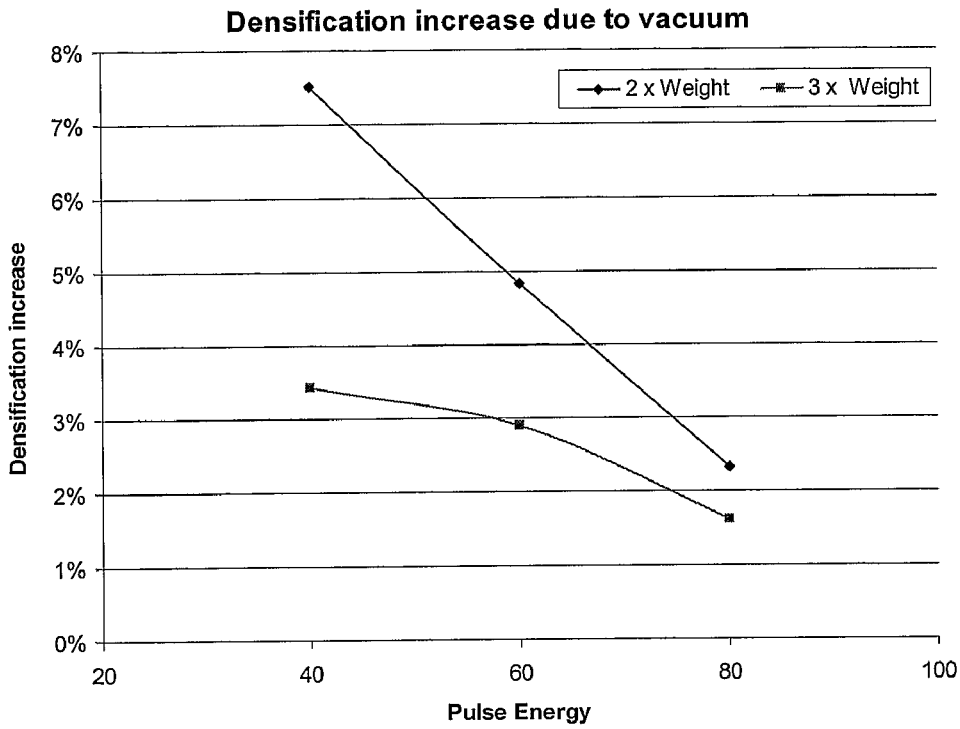
FIG. 6 shows the densification increase of a compact as a function of vacuuming using double and treble material weight.

These samples were not pre-pressed. As before, 5.12 g of encapsulated diamond material was used. This was added to the sintering chamber which was then put under a vacuum using a rotary vacuum pump. It is estimated that the vacuum achieved was not better than $10^{-2}$ mbar and probably of the order of $10^{-1}$ mbar. Samples were sintered at 20 and 30% pulse energy and 20, 40 & 60 kN. The densification increases that were achieved over standard sintered samples which were not pre-pressed are shown in FIG. 5. Repeats using double and treble weights but under vacuum were also repeated, at 40, 60 and 80% pulse energy and 40 kN. The increase in densification due to the vacuum is shown in FIG. 6.

EXAMPLE 5

Figure 7:
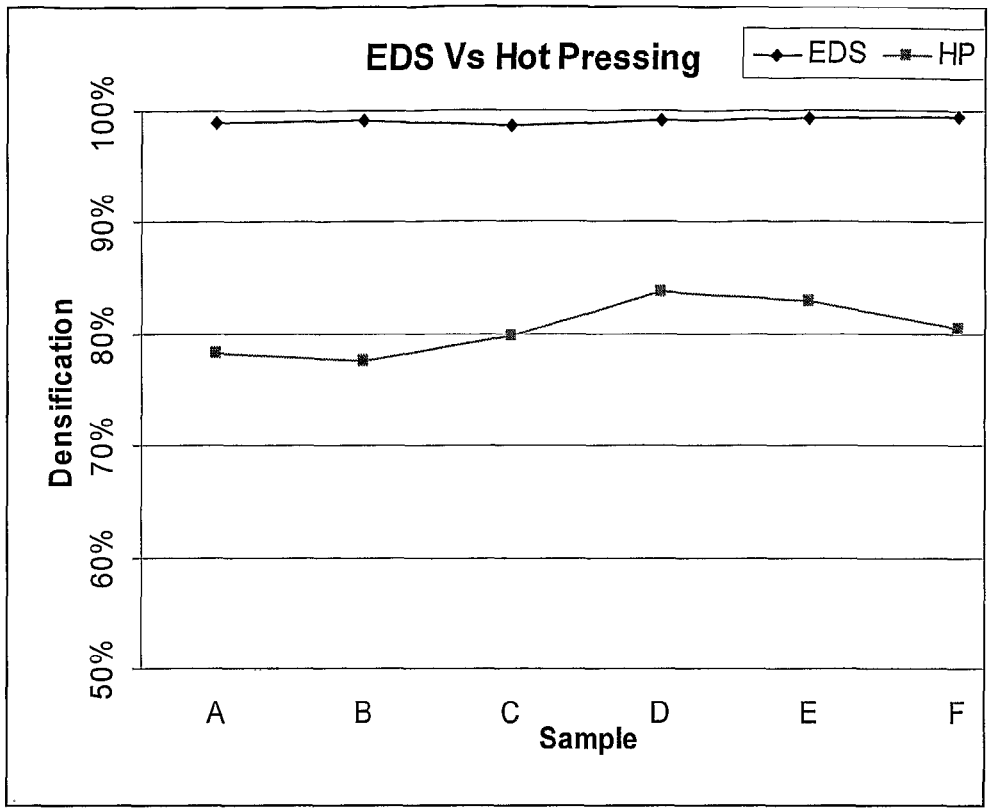
FIG. 7 shows a densification comparison of EDS v. hot pressing.
Figure 8:
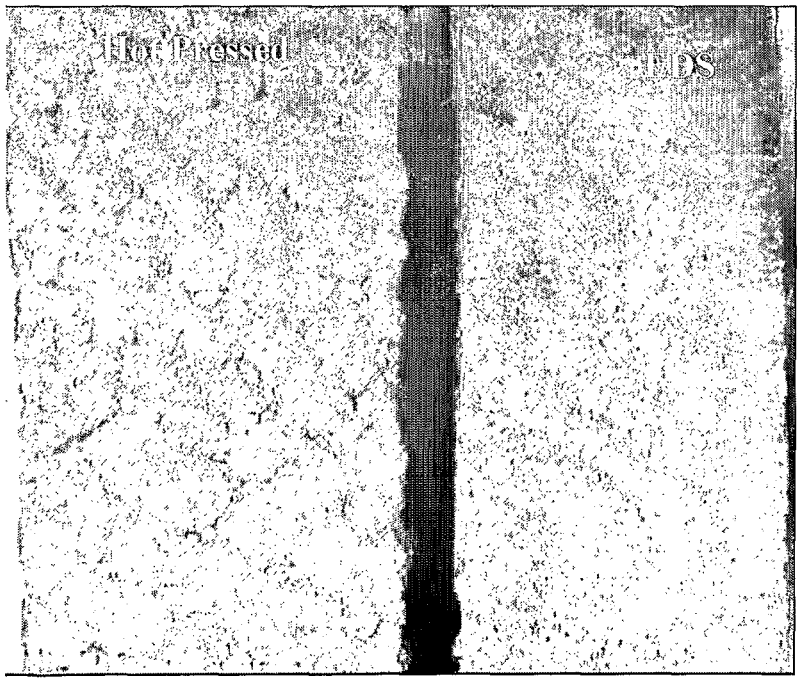
FIG. 8 shows a visual comparison of EDS v. hot pressing.

From previous Examples, it was determined that 5.12 g of the encapsulated diamond material can be well sintered using 30% power and 60 kN in the 13.8 mm die. A set of 6 samples were produced using these settings. Using a 6 chamber 15 mm diameter graphite mould, equivalent samples were hot pressed. Hot pressing was performed at 1100 deg C. using a pressing force of 300 Bar for 7 minutes at temperature. The percentage densification which was achieved for each sample was calculated from sample dimensions and is shown FIG. 7. Obviously, the hot pressed samples are much less densified than the electro discharge sintering (EDS) samples. Visually this can be seen in FIG. 8, where the disc edge clearly on the left shows the un-sintered granules. The disc edge on the right appears fully sintered

EXAMPLE 6

For this set of experiments a different encapsulated diamond was used. The bonding powder material used to encapsulated the diamond was tungsten carbide powder with 10 weight % cobalt powder. A series of discs were produced at various forces and energies to produce a fully sintered compact. These settings were 70% energy with 40 kN of force. To compare these to mixed diamond and bond powder, a standard sintered carbide precursor material, tungsten carbide with 11 weight % cobalt, was used and any organic binder was removed before use. Equivalent weights of diamond and bond material to that in an encapsulated diamond sample were mixed and poured into the sintering chamber, sintering was performed at 70% energy with 40 kN of force as with the encapsulated samples. Several repeats were performed.

Figure 9:
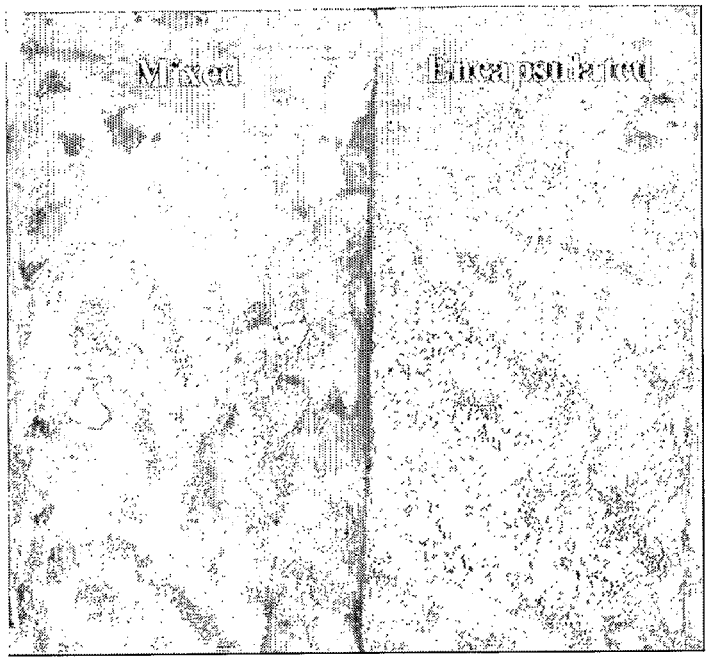
FIG. 9 shows a visual comparison of an encapsulated compact v. a non-encapsulated compact.

In FIG. 9, the disc on the left clearly shows the agglomeration of diamond causing the disc to break up. The disc on the right in the same image was made using encapsulated diamond and doesn't show any such damage.

EXAMPLE 7

Figure 10:
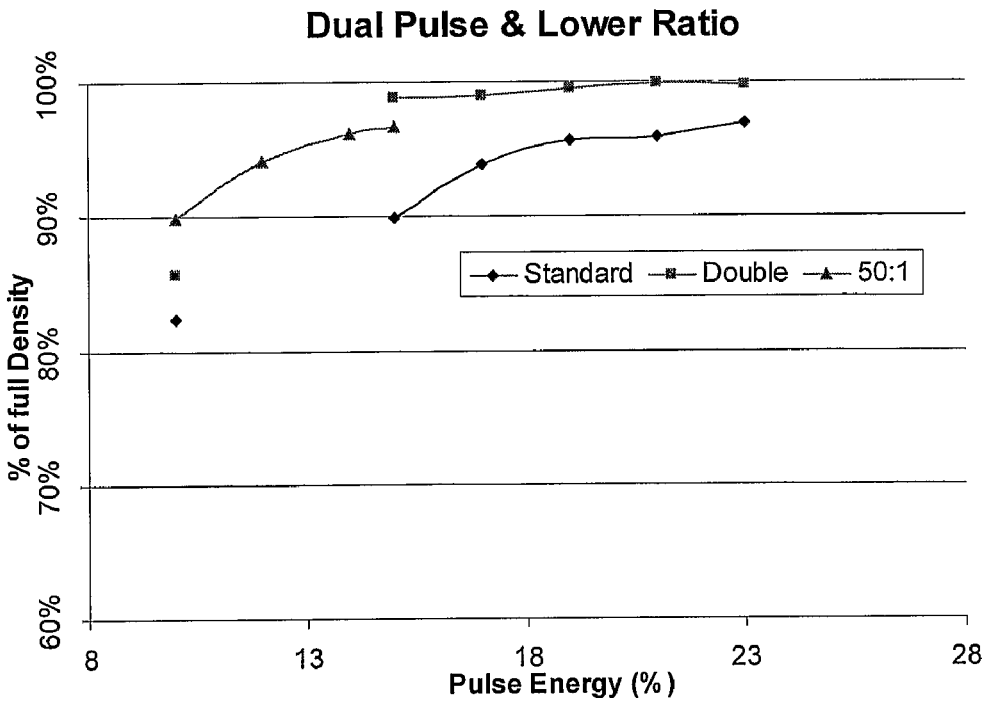
FIG. 10 shows % of full density against pulse energy.

Using an 11.31 mm diameter die, 3.43 g of material was sintered at 10, 15, 17, 19, 21 & 23% energy. This experiment was repeated using two current pulses. The transformer ratio was also changed from 100:1 to 50:1, which had the effect of increasing the pulse height while decreasing the pulse duration. The % of full densification measured for each sample is shown in FIG. 10

EXAMPLE 8

Figure 11:
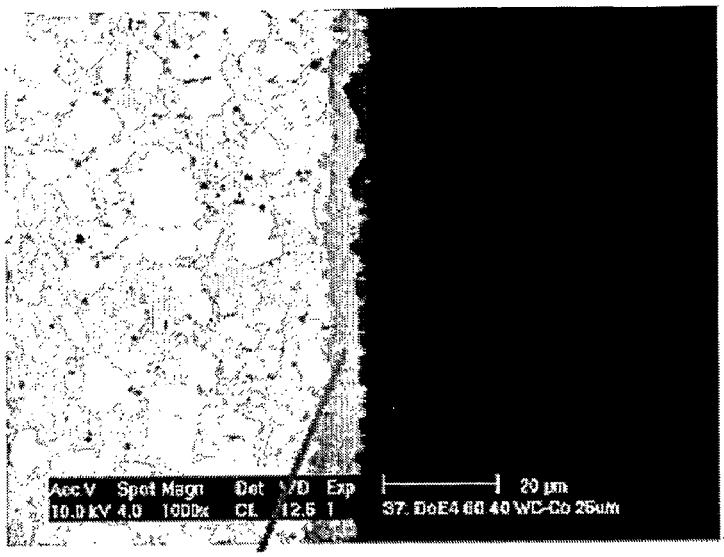
FIG. 11 shows a cross sectional scanning electron microscope analysis of a diamond (black portion) bonded to a TiC coating (grey) in a Co/WC matrix.

SEM analysis has shown that there is very good bonding between the coated diamond and carbide/cobalt matrix. This bond is created through the dissolution of some of the TiC coating on the diamond in the metal matrix (see FIG. 11).

EXAMPLE 9

Using an 11.31 mm diameter die, 6.86 g of material (double that used before) was sintered at 50 and 70% energy using a pressing force of 30 kN. This was repeated using pre-pressing, pre-heating, dual pulses and vacuuming. All of these were then combined to see what resulted.

Figure 12A:
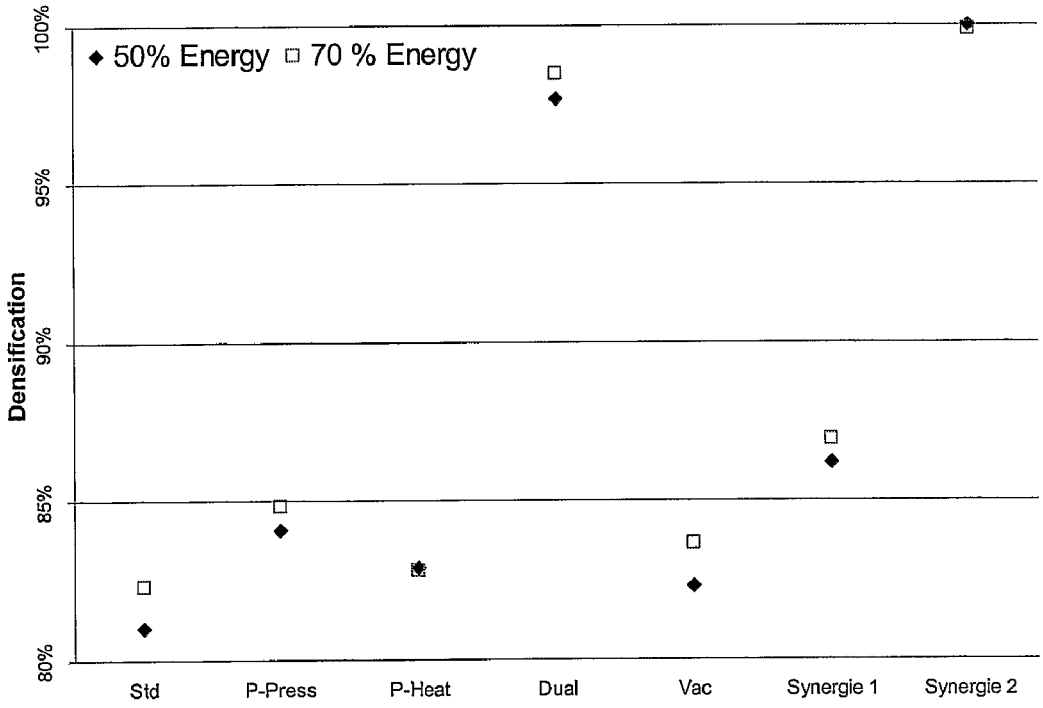
FIG. 12A shows the super additive effects of each of the above teachings.

As FIG. 12A shows, using 70% energy improves densification above 50% energy. The greatest improvement in densification results when dual pulses are used, but yet not to 100% densification. 100% densification only results when all the improvements are put together.

EXAMPLE 10

Figure 12B:
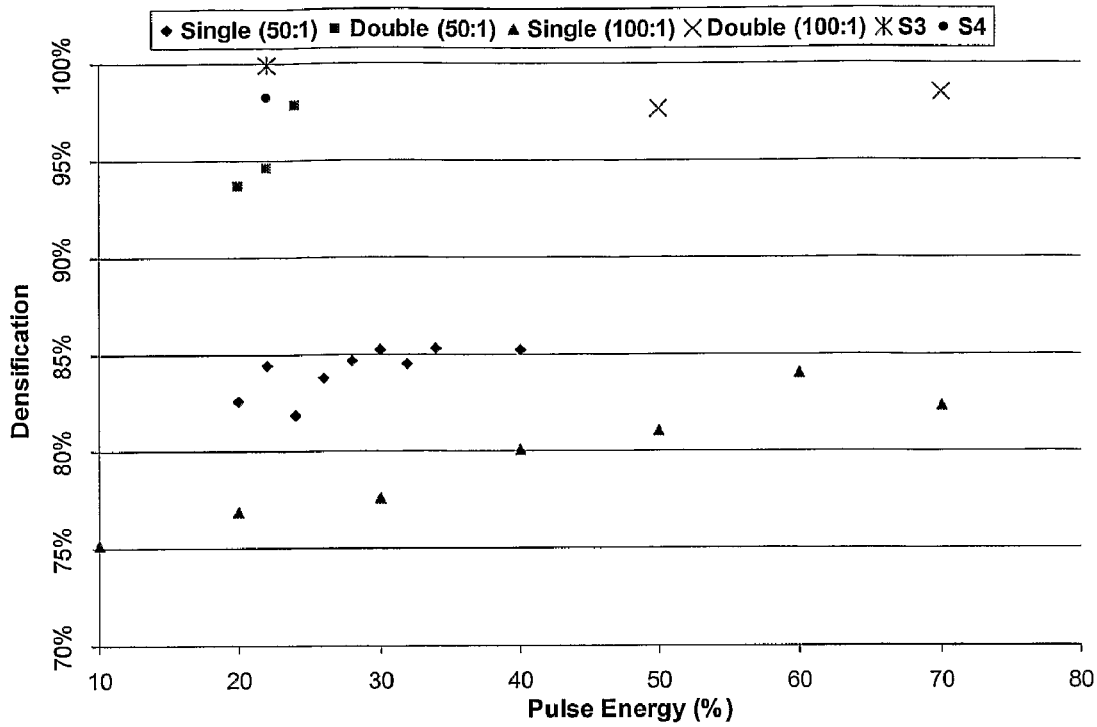
FIG. 12B shows the super additive effects of each of the above teachings.

More experiments were done at energies between 10 and 20% using a transformer ratio of 50:1. Again, repeats using dual pulses were done. When settings achieving high, although not full, densification then pre-pressing and vacuuming were used as well to achieve full density (see FIG. 12B). In FIG. 12B, S3 is Pre-pressed, Pre-heated, Vacuumed, Ratio of 50:1 and Double pulse, 22% energy and 30 kN punch force and S4 is Pre-pressed, Vacuumed, Ratio of 50:1 and Double pulse. 22% energy and 30 kN punch force.

EXAMPLE 11

It was determined that to sinter some samples to high density energies were required which welded the copper electrode punches to the sample. By using shims of copper infiltrated tungsten material (circa 2-3 mm thick) this welding was prevented as the Cu/W material is much less susceptible to arcing.

EXAMPLE 12

The wear properties of diamond grit loaded tungsten carbide D-WC in terms of material lost ($\mu mh^{-1}$) were directly compared with chemical vapour deposition (CVD) diamond in a very severe diamond lapping wear rate test. The CVD diamond is a synthetic form of polycrystalline diamond used in a variety of industrial uses. Comprising of pure diamond it exhibits the same hardness as other forms of diamond and in abrasive conditions exhibits very low wear rates.

Three 17 mm diameter disks of D-WC and three matching disks of optical grade CVD diamond were prepared to similar states of surface roughness, (Ra 200 nm) prior to the lapping experiment. The disks contained 30/35# SDB1100 diamond with a concentration of approximately 100 in a cobalt/WC bond. The samples were mounted onto holders using wax and the holders were placed on the rotating wheel weighed down with 360 g. Suspensions of 325 grade HPHT grit in solutions were dripped on to iron scaffe rotating at 80 RPM. The thickness of the each sample was measured using a calibrated micrometer at 30 minute intervals. The steady state wear for the CVD diamond samples was 16 $\mu mh^{-1}$ and for the D-WC samples it was 40 $\mu mh^{-1}$.

The invention claimed is:

1. A method of producing a high-density abrasive compact material, the method comprising:

a) providing an electrically conductive mixture of a bonding powder material and abrasive particles or grit;

b) encapsulating the abrasive particles or grit with the bonding powder material and placing the encapsulated abrasive particles or grit in a die;

c) compressing the electrically conductive mixture in the die; and d) subjecting the compressed electrically conductive mixture to one or more high current pulses to form the abrasive compact, wherein the pulses are in excess of 1 $kA/cm^2$, wherein encapsulating the abrasive particles or grit with the bonding powder material further comprises a binder and wherein the binder is removed prior to the compressing in c).

2. The method as claimed in claim 1 wherein the abrasive particles or grit are selected from diamond, cubic boron nitride (cBN), alumina ($Al_2O_3$), silicon carbide (SiC), silicon nitride ($Si_3Ni_4$), garnet, WC and zirconia.

3. The method as claimed in claim 1 wherein the bonding powder material is a metal powder material and/or a semiconductor powder material.

4. The method as claimed in claim 3 wherein the semiconductor powder material is selected from any one or more of silicon (Si), germanium (Ge) and Gallium (Ga).

5. The method according to claim 1 wherein the abrasive particles are pre-coated with a metal coating.

6. The method as claimed in claim 5 wherein the coating is selected from titanium carbide, chromium carbide, titanium metal, tungsten metal and nickel.

7. The method according to claim 1 wherein the abrasive particles and/or grit are at least partially sintered before being compressed.

8. The method according to claim 1 wherein the electrically conductive mixture is pre-pressed near net shape prior to being sintered.

9. The method according to claim 1 wherein the electrically conductive material is placed under a vacuum during a pre-sintering step, compressing step (b), or during the pre-pressing step, or any or all.

10. The method according to claim 1 wherein the compressed electrically conductive mixture or pre-pressed compact is pre-heated before being subjected to the high current pulse(s).

11. The method according to claim 1 wherein the bonding metal powder material is selected from iron, cobalt, copper, bronze, brass, Ni, Al, Ti, Zn, Y, Zr, Nb, Mo, Ag, Sn, Ta, W Pt and Au or mixtures thereof, or pre-alloyed materials based on these metals.

12. The method according to claim 1 wherein the bonding powder material includes non-conducting additives such as metallic carbides, nitrides, oxides and cermets.

13. The method according to claim 1, wherein the encapsulating yields surrounding the abrasive particles or grit by the bonding powder material.

* * * * *